US006059131A

United States Patent [19]

Harris

[11] Patent Number: 6,059,131

[45] Date of Patent: May 9, 2000

[54] REMOVABLE PRESSURE RELEASING SYSTEM

[76] Inventor: Patrick G. Harris, 1 Wolverton Aylesbury Estate, East Street, London, SE17 2AA, United Kingdom

[21] Appl. No.: 08/689,880

[22] Filed: Aug. 15, 1996

[51] Int. Cl.[7] ..... B65B 3/04

[52] U.S. Cl. ..... 215/18; 215/252

[58] Field of Search ..... 215/18–24, 252; 137/315, 147

[56] References Cited

U.S. PATENT DOCUMENTS

| | | | |
|---|---|---|---|
| 579,629 | 3/1897 | Wilson | 215/18 |
| 707,199 | 8/1902 | Blocker | 215/19 |
| 1,001,744 | 8/1911 | Edwards | 215/19 |
| 1,069,969 | 8/1913 | McGinniess | 215/19 |
| 2,148,440 | 2/1939 | Davis | 215/19 |
| 2,241,394 | 5/1941 | Duffy | 215/19 |
| 2,869,747 | 1/1959 | Patterson | 215/19 |

*Primary Examiner*—Joseph M. Moy

[57] ABSTRACT

A new Removable Pressure Releasing System for facilitating a swift and safe method with which to release from within a carbonated beverage container and other pressurized containers the extreme and sometimes dangerous pressurized gases which may accumulate. The inventive device includes a valve assembly which is removably mounted to the mouth of the carbonated beverage container whereby the user may release the pressurized gas by simply pressing the spherical valve member terminating the seal and allowing the gas to be released, and a valve lid for protection from accidental movement of the spherical valve member.

4 Claims, 3 Drawing Sheets

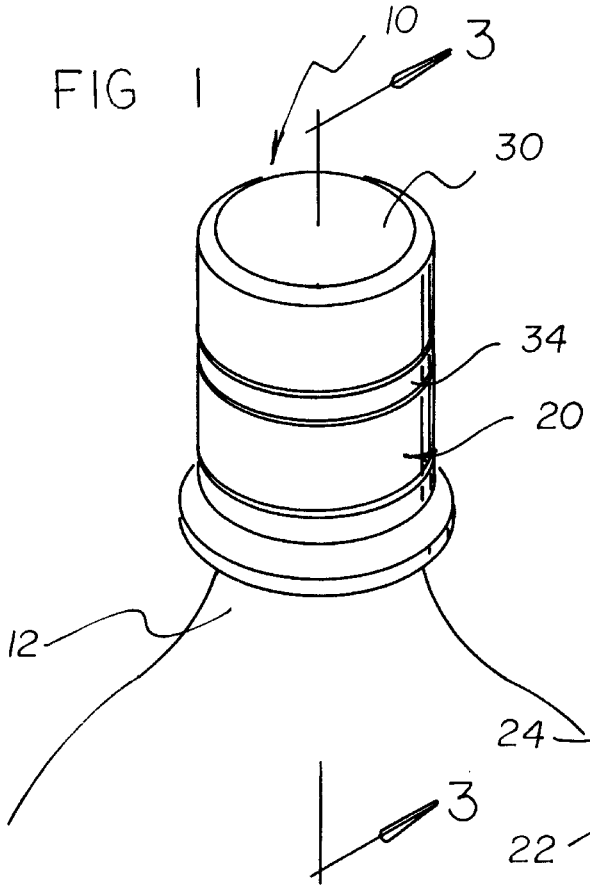
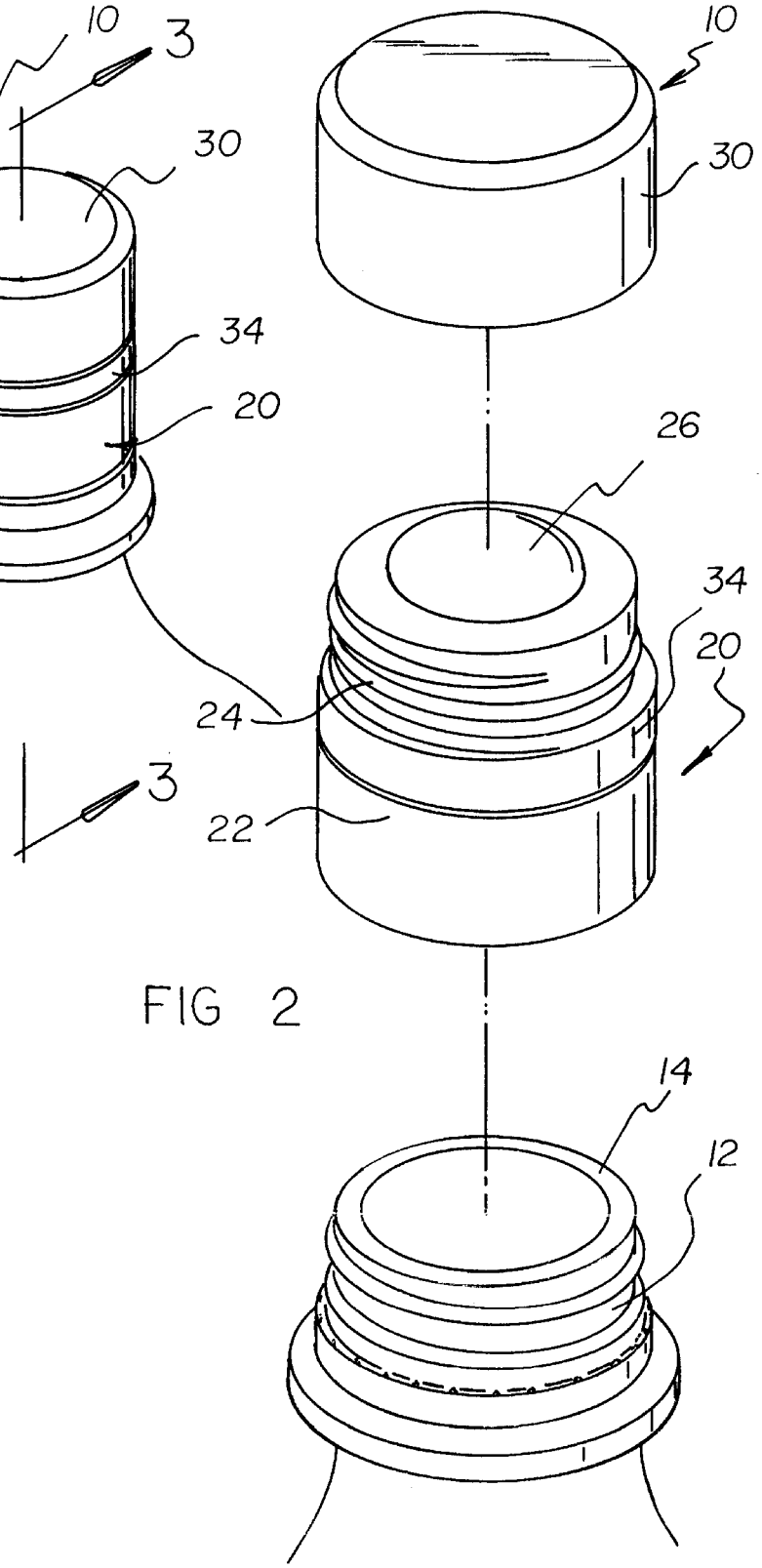
FIG 2

REMOVABLE PRESSURE RELEASING SYSTEM

BACKGROUND OF THE INVENTION

1. Field of the Invention

The present invention relates to Carbonated Beverage Bottle Devices and more particularly pertains to a new Removable Pressure Releasing System for facilitating a swift and safe method with which to release from within a carbonated beverage container and other pressurized containers the extreme and sometimes dangerous pressurized gases which may accumulate.

2. Description of the Prior Art

The use of Carbonated Beverage Bottle Devices is known in the prior art. More specifically, Carbonated Beverage Bottle Devices heretofore devised and utilized are known to consist basically of familiar, expected and obvious structural configurations, notwithstanding the myriad of designs encompassed by the crowded prior art which have been developed for the fulfillment of countless objectives and requirements.

While these devices fulfill their respective, particular objectives and requirements, the aforementioned patents do not disclose a new Removable Pressure Releasing System. The inventive device includes a valve assembly which is removably mounted to the mouth of the carbonated beverage container whereby the user may release the pressurized gas by simply pressing the spherical valve member terminating the seal and allowing the gas to be released, and a valve lid for protection from accidental movement of the spherical valve member.

In these respects, the Removable Pressure Releasing System according to the present invention substantially departs from the conventional concepts and designs of the prior art, and in so doing provides an apparatus primarily developed for the purpose of facilitating a swift and safe method with which to release from within a carbonated beverage container and other pressurized containers the extreme and sometimes dangerous pressurized gases which may accumulate.

SUMMARY OF THE INVENTION

In view of the foregoing disadvantages inherent in the known types of Carbonated Beverage Bottle Devices now present in the prior art, the present invention provides a new Removable Pressure Releasing System construction wherein the same can be utilized for facilitating a swift and safe method with which to release from within a carbonated beverage container and other pressurized containers the extreme and sometimes dangerous pressurized gases which may accumulate.

The general purpose of the present invention, which will be described subsequently in greater detail, is to provide a new Removable Pressure Releasing System apparatus and method which has many of the advantages of the Carbonated Beverage Bottle Devices mentioned heretofore and many novel features that result in a new Removable Pressure Releasing System which is not anticipated, rendered obvious, suggested, or even implied by any of the prior art Carbonated Beverage Bottle Devices, either alone or in any combination thereof.

To attain this, the present invention generally comprises a valve assembly which is removably mounted to the mouth of the carbonated beverage container whereby the user may release the pressurized gas by simply pressing the spherical valve member terminating the seal and allowing the gas to be released, and a valve lid for protection from accidental movement of the spherical valve member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Removable Pressure Releasing System apparatus and method which has many of the advantages of the Carbonated Beverage Bottle Devices mentioned heretofore and many novel features that result in a new Removable Pressure Releasing System which is not anticipated, rendered obvious, suggested, or even implied by any of the prior art Carbonated Beverage Bottle Devices, either alone or in any combination thereof.

It is another object of the present invention to provide a new Removable Pressure Releasing System which may be easily and efficiently manufactured and marketed.

It is a further object of the present invention to provide a new Removable Pressure Releasing System which is of a durable and reliable construction.

An even further object of the present invention is to provide a new Removable Pressure Releasing System which is susceptible of a low cost of manufacture with regard to both materials and labor, and which accordingly is then susceptible of low prices of sale to the consuming public, thereby making such Removable Pressure Releasing System economically available to the buying public.

Still yet another object of the present invention is to provide a new Removable Pressure Releasing System which provides in the apparatuses and methods of the prior art some of the advantages thereof, while simultaneously overcoming some of the disadvantages normally associated therewith.

Still another object of the present invention is to provide a new Removable Pressure Releasing System for facilitating a swift and safe method with which to release from within a carbonated beverage container and other pressurized containers the extreme and sometimes dangerous pressurized gases which may accumulate.

Yet another object of the present invention is to provide a new Removable Pressure Releasing System which includes a valve assembly which is removably mounted to the mouth of the carbonated beverage container whereby the user may release the pressurized gas by simply pressing the spherical valve member terminating the seal and allowing the gas to be released, and a valve lid for protection from accidental movement of the spherical valve member.

Still yet another object of the present invention is to provide a new Removable Pressure Releasing System that does not require toos or implements to operate or remove.

Even still another object of the present invention is to provide a new Removable Pressure Releasing System that can be easily retained in position by its internal screw-thread and security seal to existing and future shaped bottles.

Still another object of the present invention is to provide a new Removable Pressure Releasing System that can have permanently or temporarily secured to its body a lid of various designs with its own security tamperproof seal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an upper side perspective view of a new Removable Pressure Releasing System according to the present invention.

FIG. 2 is an exploded isometric illustration of the present invention in relation to the mouth of a carbonated beverage container.

DESCRIPTION OF THE PREFERRED EMBODIMENT

Figure 3:
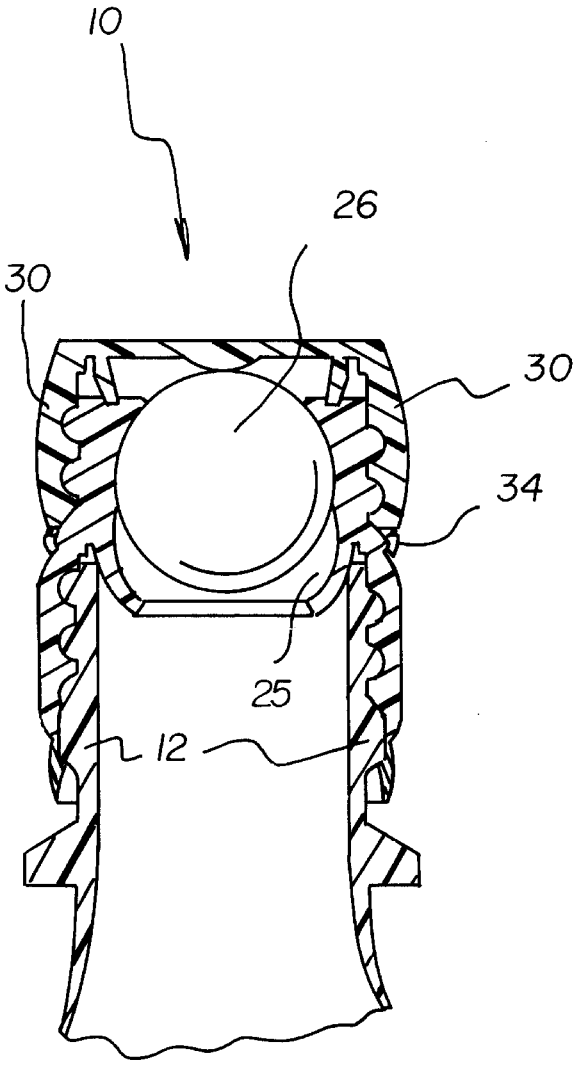
FIG. 3 is a cross sectional view taken along line 3—3 of FIG. 2 disclosing the spherical valve member captured within the boule gas passage in the sealed position.

With reference now to the drawings, and in particular to FIGS. 1 through 6 thereof, a new Removable Pressure Releasing System embodying the principles and concepts of the present invention and generally designated by the reference numeral 10 will be described.

More specifically, it will be noted that the Removable Pressure Releasing System 10 comprises a valve assembly 20 which removably couples to a mouth 14 of a unnumbered carbonated beverage container, and a valve lid 30 which removably couples to the valve assembly 20 opposite of the unnumbered carbonated beverage container.

Figure 4:
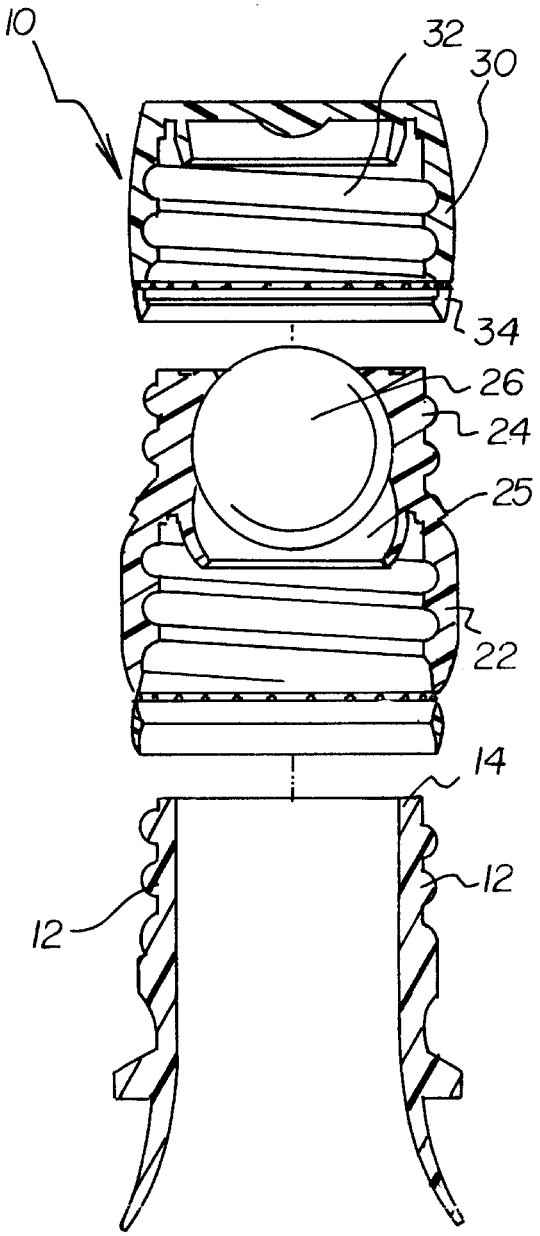
FIG. 4 is an isometric view of FIG. 3 further disclosing the relation of the valve lid to the valve assembly.
Figure 5:
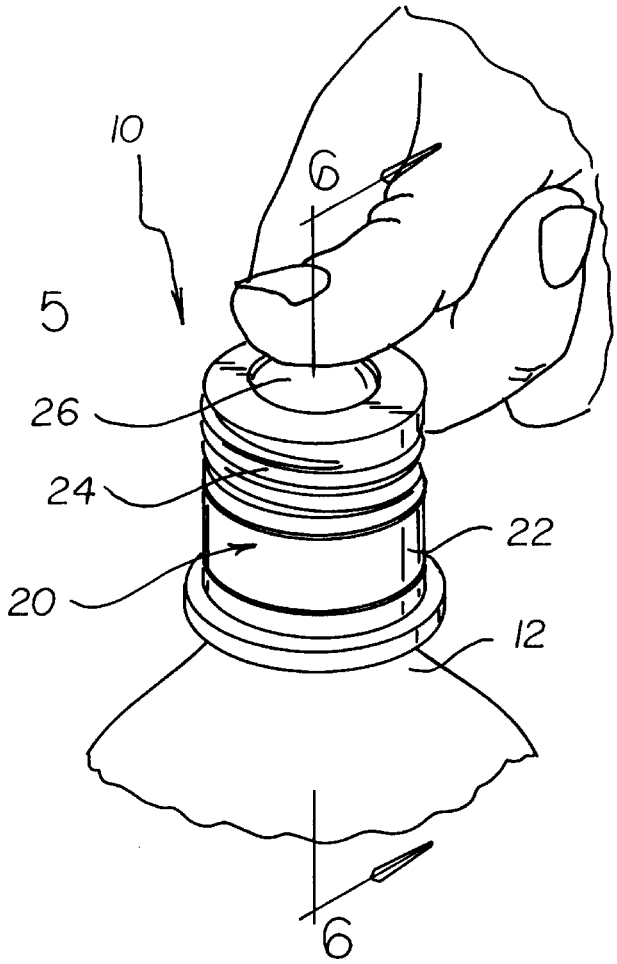
FIG. 5 is a side perspective view of the present invention with the user forcing the spherical valve member into the lower portion of the boule gas passage which is in the gas releasing position.
Figure 6:
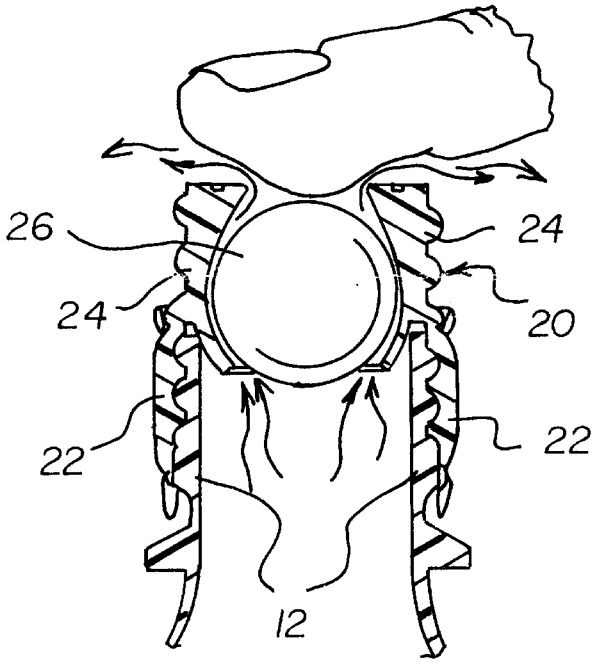
FIG. 6 is a cross sectional view taken along line 6—6 of FIG. 5 disclosing the spherical valve member in the gas releasing position.

As best illustrated in FIGS. 1 through 6, it can be shown that the valve assembly 20 includes a threaded female coupler 22 rotatably securing to a threaded bottle neck 12. A threaded male coupler 24 is secured to the threaded female coupler 22 opposite of the threaded bottle neck 12. The threaded female coupler 22 and threaded male coupler 24 include a boule gas passage 25 projecting from the end of the threaded female coupler 22 opposite of the threaded male coupler 24 projecting to and through the end of the threaded male coupler 24 opposite of the female coupler as best disclosed in FIGS. 3–4 and 6. A spherical valve member 26 is slidably positioned within the boule gas passage 25 as shown in FIGS. 3–4 and 6. The spherical valve member 26 is contained within the boule gas passage 25 and seals the boule gas passage 25 when pressure has accumulated within the unnumbered carbonated beverage container retaining the pressure forcing the spherical valve member 26 juxtaposed to the upper interior edge of the boule gas passage 25 as best shown in FIGS. 3–4. The user exerts force to the spherical valve member 26 downward into the wider portion of the boule gas passage 25 providing a path for the pressurized gas to radiate out as disclosed in FIGS. 5–6. The valve lid 30 includes a volute slot 32 interiorly which couples with the threaded male end of the valve assembly 20 as shown in FIG. 4 of the drawings. As best disclosed in FIG. 4 of the drawings, the valve assembly 20 preferably includes a tamperproof seal 34 removably secured to the lower edge of the valve lid 30. The valve assembly 20 and valve lid 30 are preferably constructed from molded plastic or light metal alloy for strength and lightness.

In use, the user or company making the unnumbered carbonated beverage couples the valve assembly 20 to the threaded bottle neck 12. The valve lid is then secured to the upper portion of the valve assembly 20. The user of the unnumbered carbonated beverage container then removes the valve lid 30 by simply rotating the valve lid 30. During travel, there is presumed to be a substantially amount of accumulated pressure from the unnumbered carbonated beverage from within. After removal of the valve lid 30, the user presses the partially protruding spherical valve member 26, as best shown in FIGS. 5–6, downward into the wider portion of the boule gas passage 25. The accumulated pressure is thereby released around the spherical valve member 26 through the boule gas passage 25 reducing the pressure to nothing over a finite period of time. The user is then able to remove the valve assembly 20 so as to consume the depressurized unnumbered carbonated beverage. After consumption of a finite amount, the user may resecure the valve assembly 20 and valve lid 30 for later use in protecting the user from exploding carbonated beverages.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Removable Pressure Releasing System comprising:

a valve assembly removably mountable to the mouth of a beverage container; and a valve lid removably mountable to the valve assembly;

wherein the valve assembly includes:

a substantially tubular member with a gas passage therethrough, said tubular member having an internally-threaded female coupler portion on one end of said tubular member for rotatably securing to a threaded neck of a beverage container, and an externally-threaded male coupler portion on the other end of said tubular member for rotatable receiving said valve lid;

an annular retaining lip located at each end of said gas passage reducing the diameter size of the gas passage at each end of said tubular member; and a spherical valve member slidably positioned within the gas passage and contained between the annular retainer lips located at each end of the gas passage, wherein said gas passage has an interior surface defining at least two positions for said spherical valve member in said passage, a first said position located adjacent to the end of said tubular member having said male coupler portion thereon, the interior surface of said gas passage at said first position being of a diameter size substantially equal to the size of said spherical valve member such that the spherical valve member in said first position resists the movement of gas between said spherical valve member and the interior surface of said gas passage and thereby substantially blocks gas and liquid movement through said valve assembly, a second said position located between said first position and the annular retaining lip at said female coupler portion end of said tubular member, the interior surface of said gas passage at said second position being of a diameter size larger than said spherical valve member such that said spherical valve member in said second position permits the movement of gas between said spherical valve member and the interior surface of said gas passage and thereby permits gas movement through said valve assembly, wherein the buildup of gas pressure in a beverage container on which said valve assembly is mounted biases said spherical valve member into said first position for blocking release of gas from said container, and wherein a user is able to apply finger force directly to the spherical valve member to move the spherical valve member from said first position into said second position to release gas from said beverage container through the gas passage in a finger controllable manner before removal of said valve assembly from a said container;

wherein said spherical valve member prevents the escape of liquid from a beverage container mounted thereto when said beverage container is inverted.

2. The Removable Pressure Releasing System of claim 1, wherein the valve lid includes a volute slot interiorly which couples with the threaded male end of the valve assembly.

3. The Removable Pressure Releasing System of claim 2, wherein the valve assembly includes a tamperproof seal removably secured to the lower edge of the valve lid.

4. The Removable Pressure Releasing System of claim 3, wherein the valve assembly and valve lid are constructed from molded plastic or light metal alloy for strength and lightness.

* * * * *